US012642352B2

(12) United States Patent
Merrill et al.

(10) Patent No.: US 12,642,352 B2
(45) Date of Patent: Jun. 2, 2026

(54) LOCKING MECHANISM FOR ORGANIZER

(71) Applicant: Helen of Troy Limited, St. Michael (BB)

(72) Inventors: William Jack Merrill, Brooklyn, NY (US); Jeffrey Kalinoski, Brooklyn, NY (US); Ronald Ondrey, Bayonne, NJ (US)

(73) Assignee: KAZ EUROPE SÀRL, Bussigny (CH)

( * ) Notice: Subject to any disclaimer, the term of this patent is extended or adjusted under 35 U.S.C. 154(b) by 0 days.

(21) Appl. No.: 18/939,740

(22) Filed: Nov. 7, 2024

(65) Prior Publication Data

US 2026/0123746 A1 May 7, 2026

(51) Int. Cl.

| | |
|---|---|
| ***A47B 57/58*** | (2006.01) |
| ***A47B 47/02*** | (2006.01) |
| *A47B 57/06* | (2006.01) |
| *A47B 57/08* | (2006.01) |
| *A47B 57/26* | (2006.01) |
| *A47B 57/34* | (2006.01) |

(52) U.S. Cl.

CPC ..... *A47B 57/585* (2013.01); *A47B 47/022* (2013.01); *A47B 57/06* (2013.01); *A47B 57/08* (2013.01); *A47B 57/265* (2013.01); *A47B 57/34* (2013.01)

(58) Field of Classification Search

CPC ..... A47B 57/585; A47B 46/00; A47B 47/00; A47B 47/021; A47B 47/022; A47B 47/024; A47B 57/00; A47B 57/045; A47B 57/06; A47B 57/08; A47B 57/20; A47B 57/265; A47B 57/30; A47B 57/32; A47B 57/34; A47B 63/00; A47B 96/02; A47B 96/027; A47F 5/0081; A47F 5/0087; A47F 5/0037; A47F 7/0007; A47F 7/0042

See application file for complete search history.

(56) References Cited

U.S. PATENT DOCUMENTS

| | | | | | |
|---|---|---|---|---|---|
| 1,876,172 | A * | 9/1932 | Ruddy | A47B 57/04 | 108/1 |
| 2,006,580 | A * | 7/1935 | Broun | A47B 19/06 | 248/454 |
| 3,982,801 | A * | 9/1976 | Heidorn | A47B 57/06 | 62/132 |
| 5,152,491 | A * | 10/1992 | Forster | A47B 19/08 | 248/460 |

(Continued)

*Primary Examiner* — Devin K Barnett

(74) *Attorney, Agent, or Firm* — Rankin, Hill & Clark LLP

(57) ABSTRACT

An organizer includes a support body and organizing member mounted to the support body. The organizing member is slidable relative to the support body. A locking mechanism locks a position of the organizing member relative to the base. The locking mechanism includes a first locking member and a second locking member. The first locking member is secured by the support body and is rotatable about an axis defined by the first locking member. The first locking member includes a first engaging feature. The second locking member is provided on the organizing member and includes a second engaging feature. The first locking member is rotatable about the axis between an unlocked position where the first and second engaging features are separated and a locked position where the first and second engaging features are engaged.

15 Claims, 8 Drawing Sheets

(56) References Cited

U.S. PATENT DOCUMENTS

| | | | | |
|---|---|---|---|---|
| 5,480,119 | A * | 1/1996 | Fish | A47B 19/08 108/127 |
| 5,913,584 | A * | 6/1999 | Swindell | F25D 25/02 248/292.12 |
| 6,065,821 | A * | 5/2000 | Anderson | A47B 57/06 248/292.12 |
| 6,585,117 | B2 * | 7/2003 | LaFontaine | A47B 87/007 211/195 |
| 7,216,770 | B2 * | 5/2007 | Mueller | A47F 1/126 211/59.3 |
| 9,408,462 | B1 * | 8/2016 | Hong | F24C 15/168 |
| 9,782,017 | B1 * | 10/2017 | Luberto | A47F 1/125 |
| 9,937,615 | B1 * | 4/2018 | Winnard | B25H 3/04 |
| 10,514,213 | B2 | 12/2019 | Winnard | |
| 10,827,884 | B2 | 11/2020 | Stevens et al. | |
| 11,160,392 | B2 * | 11/2021 | Ewing | A47F 1/126 |
| 12,342,933 | B1 * | 7/2025 | Ondrasik, Jr. | A47B 57/38 |
| 2008/0048081 | A1 * | 2/2008 | Costa | A47B 96/06 248/241 |
| 2012/0306336 | A1 * | 12/2012 | Wilson | A47B 96/061 248/354.6 |
| 2014/0263134 | A1 * | 9/2014 | Walker | A47B 57/58 211/184 |
| 2021/0088270 | A1 * | 3/2021 | Allgeier | F25D 25/02 |
| 2022/0265041 | A1 * | 8/2022 | Walker | A47B 57/585 |

* cited by examiner

LOCKING MECHANISM FOR ORGANIZER

BACKGROUND

Certain cookware items such as skillets, lids for pots, pans, and cutting boards, can be challenging to store in a cabinet. Cutting boards can be stacked one atop the other, but removal of a board placed on the bottom can be tricky and may require removal of all of those on top. Similarly, skillets or frying pans can be stacked, but removing a lower pan from the stack can be an awkward exercise. Lids may not be stackable at all, or at least not feasibly when trying to stack more than two. Ideally such items could be stored in a horizontal position, held in place against falling over, thereby allowing for both efficient storage and easy removal. Existing devices provide insufficient structural support for heavy objects, or provide a complicated structure for reconfiguring and repositioning supporting dividers.

SUMMARY

According to one aspect, an organizer comprises a support body and an organizing member. The organizing member is mounted to the support body and is slidable relative to the support body. A locking mechanism is operable to lock a position of the organizing member relative to the base. The locking mechanism includes a first locking member and a second locking member. The first locking member is secured by the support body and is rotatable about an axis defined by the first locking member. The first locking member includes a first engaging feature. The second locking member is provided on the organizing member and includes a second engaging feature. The first locking member is rotatable about the axis between an unlocked position where the first and second engaging features are separated from one another and a locked position where the first and second engaging features are directly engaged to one another.

According to another aspect, a locking mechanism for an organizer is disclosed. The organizer includes a support body and an organizing member slidably mounted to the support body. The locking mechanism comprises a first locking member and a second locking member. The first locking member is rotatably secured by the support body. The first locking member includes first teeth. The second locking member is provided on the organizing member. The second locking member includes second teeth configured to meshingly interlock with the first teeth. The first locking member is rotatable between an unlocked position where the first teeth and the second teeth are separated from one another and the organizing member is slidable on the support body and a locked position where the first teeth are rotated into engagement with the second teeth and a position of the organizing member is locked relative to the support body.

DETAILED DESCRIPTION

It should, of course, be understood that the description and drawings herein are merely illustrative and that various modifications and changes can be made in the structures disclosed without departing from the present disclosure. Spatially relative terms may be used to describe an element and/or feature's relationship to another element(s) and/or feature(s) as, for example, illustrated in the figures. Further, any term of degree used herein, such as "substantially", means a reasonable amount of deviation of the modified word is contemplated such that the end result is not significantly changed. For example, such terms can be construed as allowing a deviation of at least 5% of the modified word if this deviation would not negate the meaning of the word the term of degree modifies.

Figure 1:
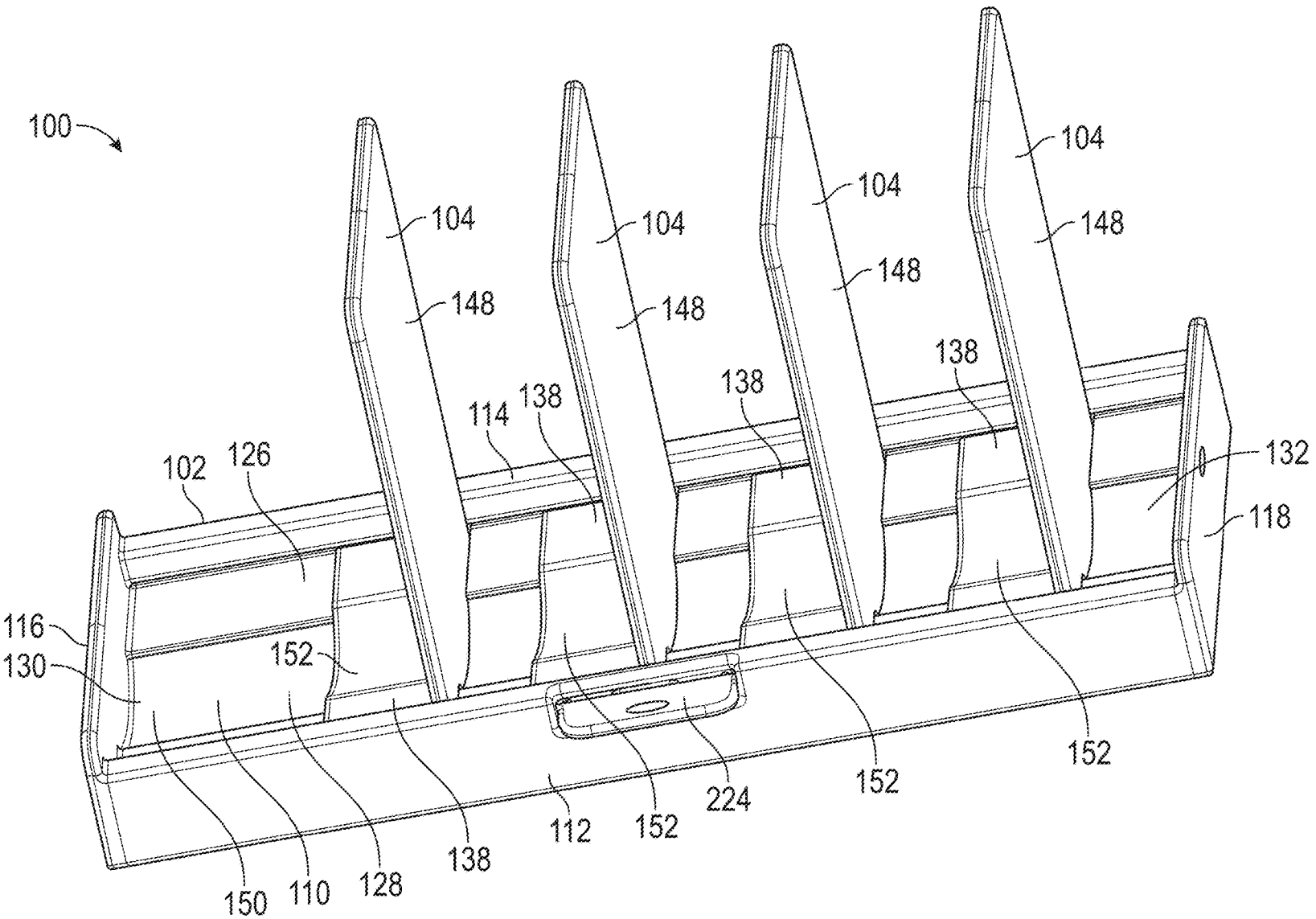
FIG. 1 is a perspective view of an organizer according to the present disclosure.
Figure 2:
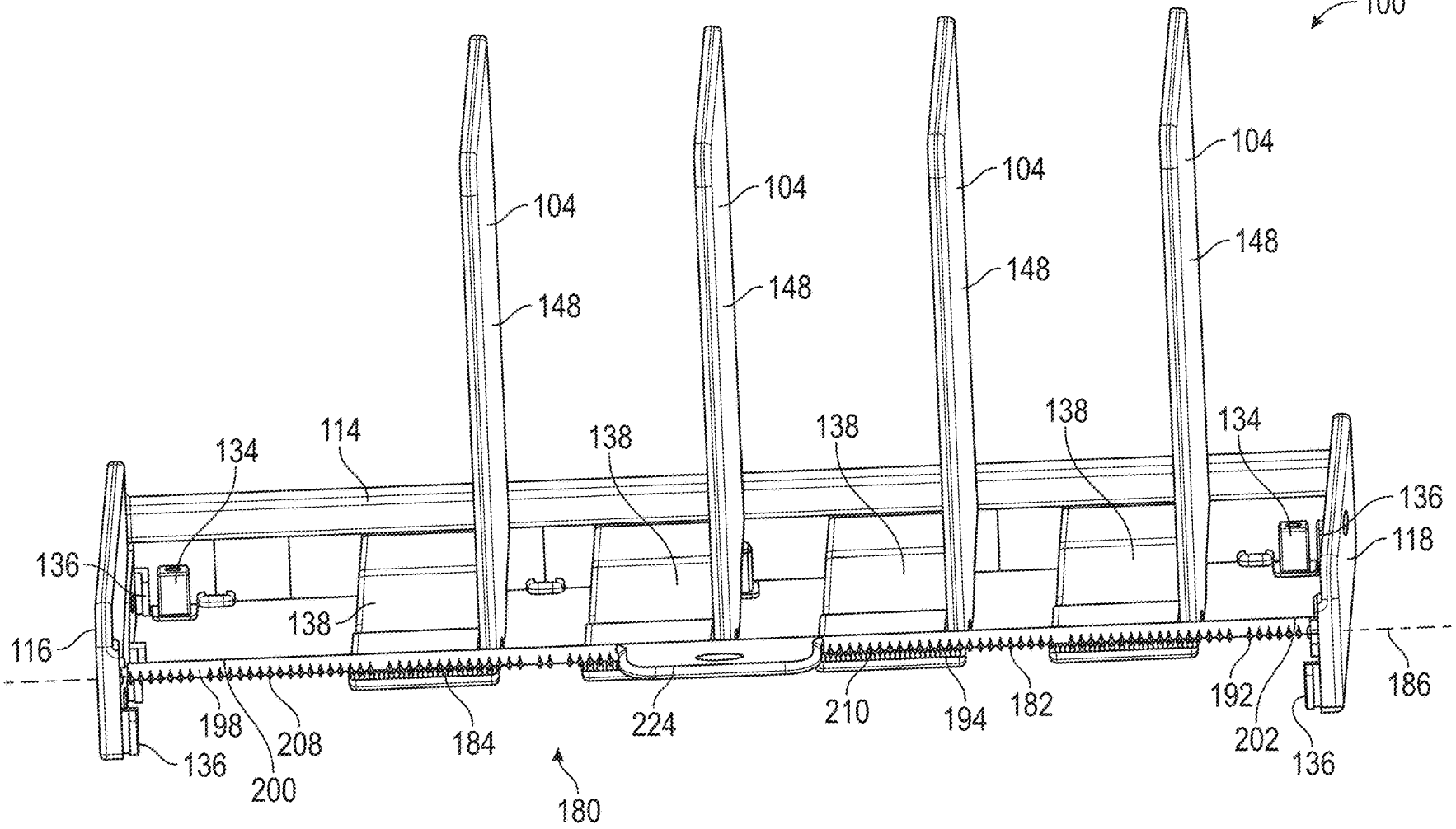
FIG. 2 is a perspective view of FIG. 1 with a sidewall removed to depict a locking mechanism.
Figure 3:
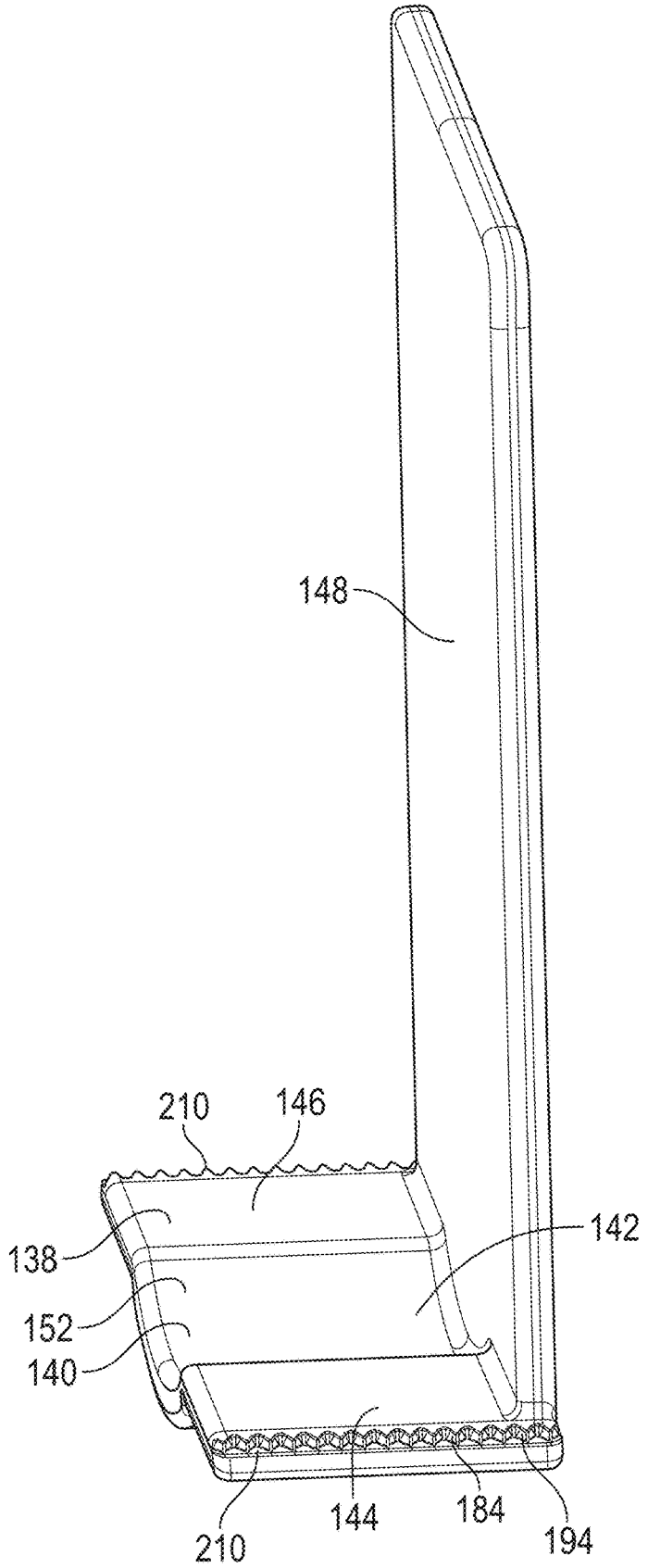
FIG. 3 is a perspective view of an organizing member of the organizer of FIG. 1.

Referring now to the drawings, wherein like numerals refer to like parts throughout the several views, FIGS. 1-3 illustrate an organizer 100 according to one aspect of the present disclosure. The organizer 100 generally includes a support body 102 and at least one organizing member 104 mounted to the support body 102 and slidable relative to the support body. In the depicted embodiment, the support body 102 is substantially rectangular shaped and includes a base 110, a first sidewall 112, a second sidewall 114 spaced from and facing the first sidewall, a first end wall 116, and a second end wall 118 spaced from and facing the first end wall. A distance between the first and second sidewalls 112, 114 define a width dimension of the support body 102, and a distance between the first and second end walls 116, 118 define a length dimension of the support body 102. The base 110 includes a first side edge portion 126 extended along the first sidewall 112, a second side edge portion 128 extended along the second sidewall 114, a first end edge portion 130 extended along the first end wall 116, and a second end edge portion 132 extended along the second end wall 118. The first and second sidewalls 112, 114 include base supports 134 and the first and second end walls 116, 118 include base supports 136. The base supports 134, 136 secure the base 110 to the first and second sidewalls 112, 114 and the first and second end walls 116, 118.

The exemplary organizing member 104 includes a support wall 138 shaped correspondingly to the base 110 so that the support wall 138 can be seated on the base. The support wall 138 includes a first side portion 140, a second side portion 142 spaced from and facing the first side portion, a first end portion 144, and a second end portion 146 spaced from and facing the first end portion. The support wall is dimensioned such that a distance between the first and second end portions 114, 146 is slightly smaller than the width dimension of the support body 112. In the depicted aspect, the organizer 100 is a cookware organizer for cookware items, such as skillets, lids for pots, pans, and cutting boards, and the organizing member 104 is a divider having a dividing wall 148 extended upwardly from, for example, the second side portion 142 of the support wall 138. The base 110 includes an arcuate recessed section 150 for rounded cookware items, and the support wall 138 includes a correspondingly shaped recessed section 152. In the depicted aspect, the organizer 100 includes plural organizing members 104 that can be adjusted to create compartments of different sizes. It should be appreciated that alternative organizers and organizing members, including their respective shapes and functions are contemplated. For example, the organizer 100 can be configured as an apparel organizer wherein the organizing members instead of dividing walls have hooks for hanging coats, hats, hoodies and the like.

To allow for sliding movement of the organizing member 104 relative to the base 110 between the first end wall 116 and the second end wall 118, the base 110 includes a track 160 and the organizing member 104 is slidable within the track. Specifically, and with reference to FIG. 4 and the second sidewall 114 and the second side edge portion 128 of the base 110, the track 160 is defined by an elongated flange 162 having a first section 164 extended substantially perpendicular to the base 110 and a second section 166 extended substantially perpendicular from the first section. The first and second sections 164, 166 form an elongated channel 168 extended between the first and second end walls 116, 118, and the channel 168 defines the track 160. As shown, the flange 162 can include a third section 168 above the second section 166. The second sidewall 114 includes an upper portion 174 shaped to substantially conceal the flange 162 except for the channel 168. The track 160 is provided along the first sidewall 112 via a similar construction of the first side edge portion 126 of the base 110. The first and second end portions 144, 146 of the support wall 138 of the organizing member 104 are received in the track 160.

Figure 4:
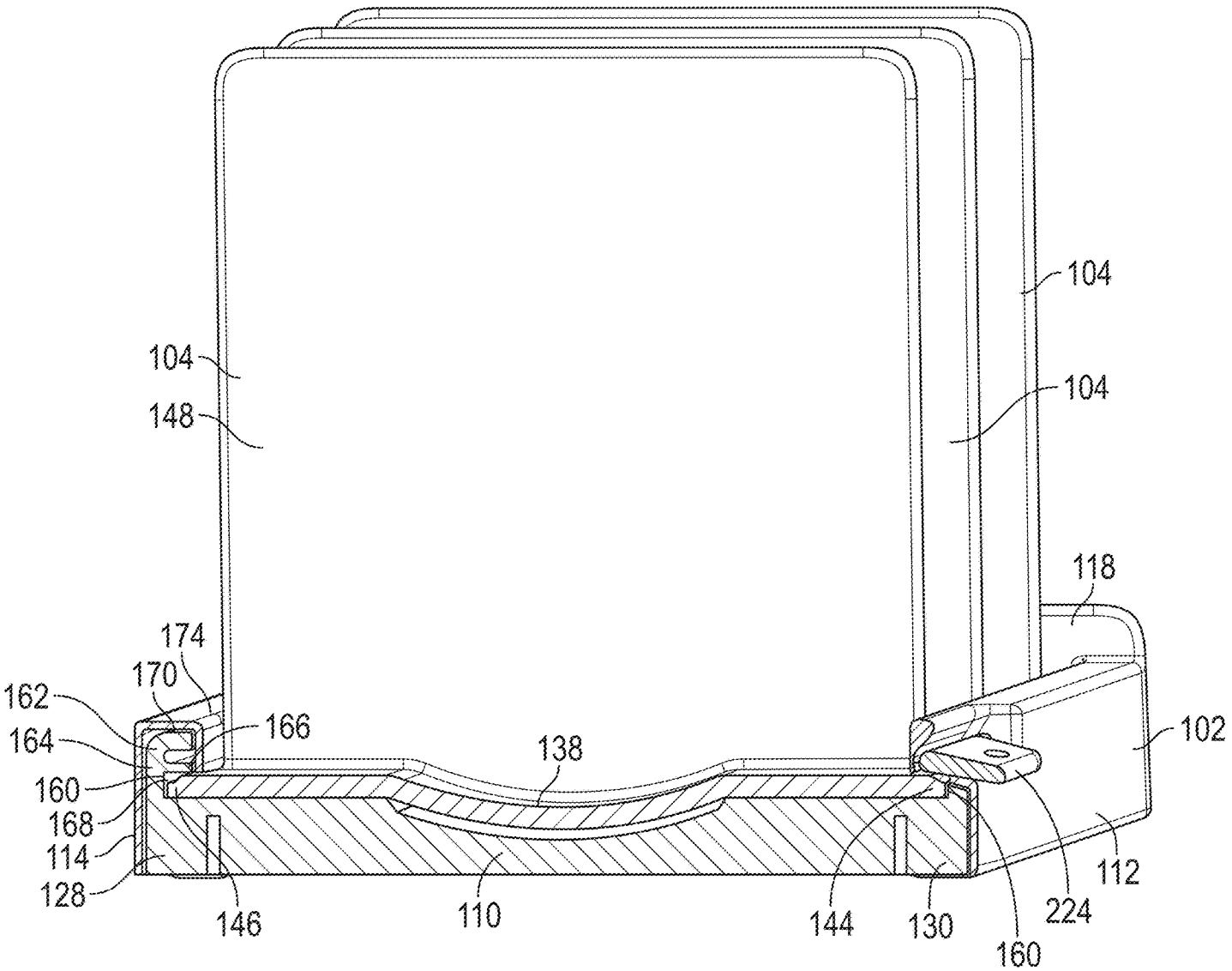
FIG. 4 is a cross-sectional view of FIG. 1.
Figure 5:
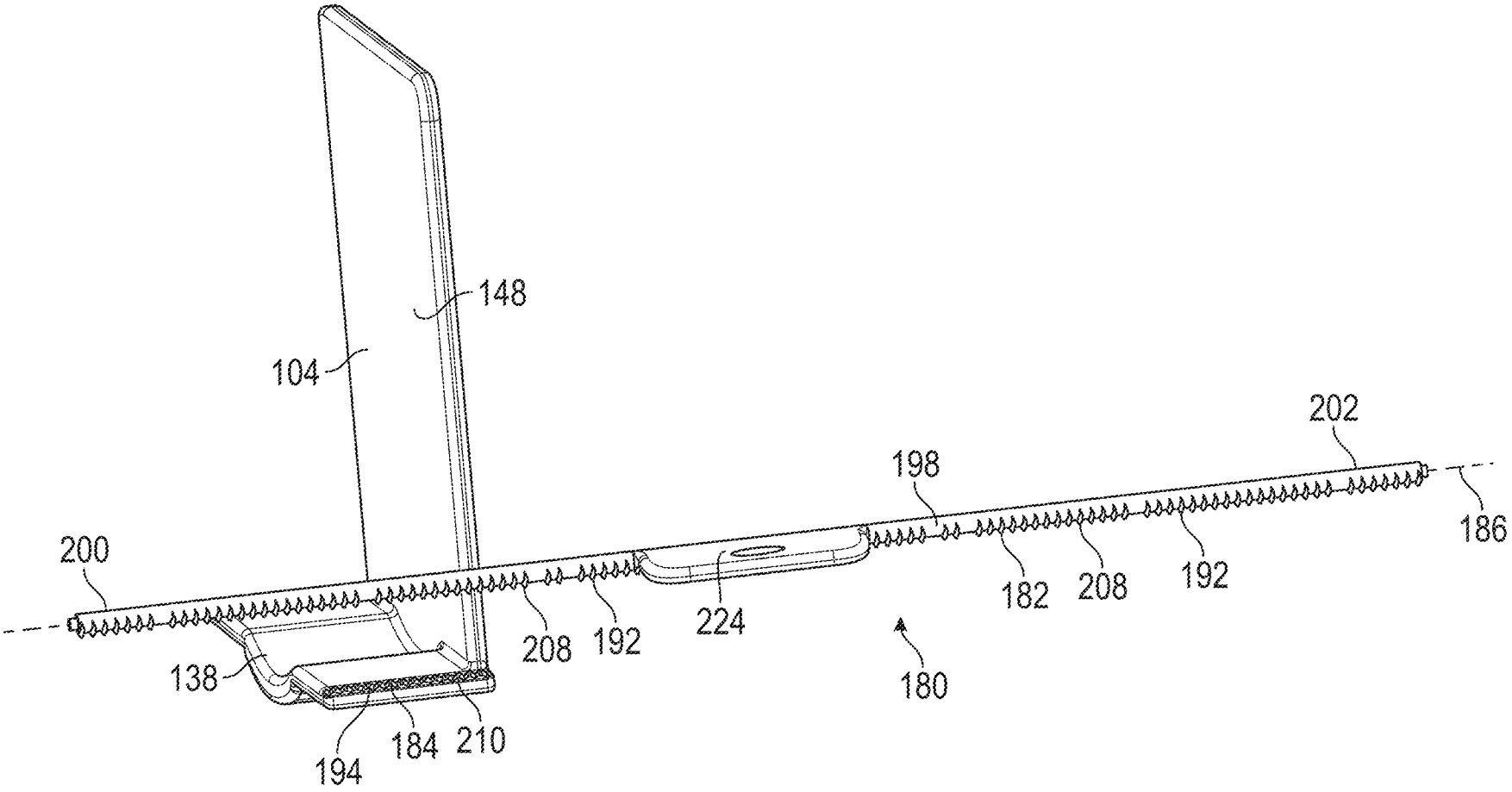
FIG. 5 is a perspective view of the locking mechanism.

The organizer 100 of the present disclosure further includes a locking mechanism 180 operable to lock a position of the organizing member 104 relative to the base 110. With reference to FIGS. 2, 4 and 5, the locking mechanism 180 includes a first locking member 182 and a second locking member 184. The first locking member 182 is secured by the support body 102 and is rotatable about an axis 186 defined by the first locking member 182. As shown, the axis 186 is extended between the first and second end walls 116, 118. The first locking member 182 includes a first engaging feature 192. The second locking member 184 is provided on the organizing member 104 and includes a second engaging feature 194. The first locking member 182 is rotatable about the axis 186 between an unlocked position where the first and second engaging features 192, 194 are separated from one another and a locked position where the first and second engaging features 192, 194 are directly engaged to one another. The organizing member 104 is slidable within the track 160 when the first locking member 182 is in the unlocked position.

The first locking member 182 includes an elongated bar 198 that defines the axis 186. The bar 198 has first and second end portions 200, 202 rotatably connected to the support body 102, and specifically to the respective first and second end walls 116, 118 in a known manner. The first engaging feature 192 includes spaced apart first teeth 208 provided on the bar 198 and arrayed along a length of the bar. The second engaging feature 194 includes spaced apart second teeth 210 adapted to meshingly interlock with the first teeth 208. The second teeth 210 are integrally formed in each of the first end portion 144 and the second end portion 146 of the support wall 138 of the organizing member 104. This allows the organizing member 104 to be rotated 180° on the base 110 without impacting operation of the locking mechanism 180. Further, the spacing of the second teeth 210 is uniform along the first end portion 144 and the second end portion 146 for reliable engagement with the first teeth 208, and the spacing of the second teeth 210 allows for minimum adjustment increments of the organizing member 104 on the support body 102.

Figure 6:
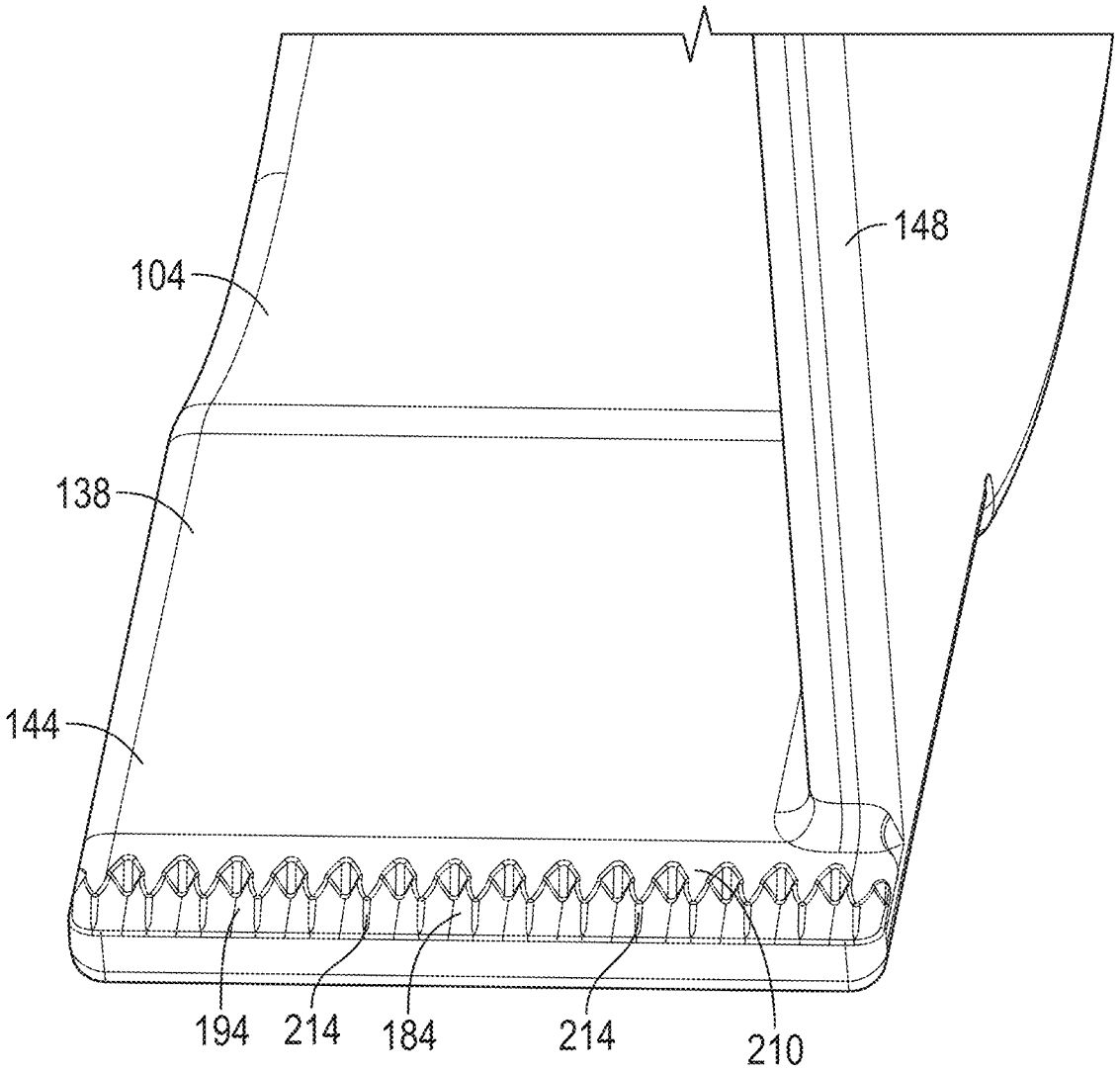
FIG. 6 is an enlarged partial perspective view of FIG. 3.
Figure 7:
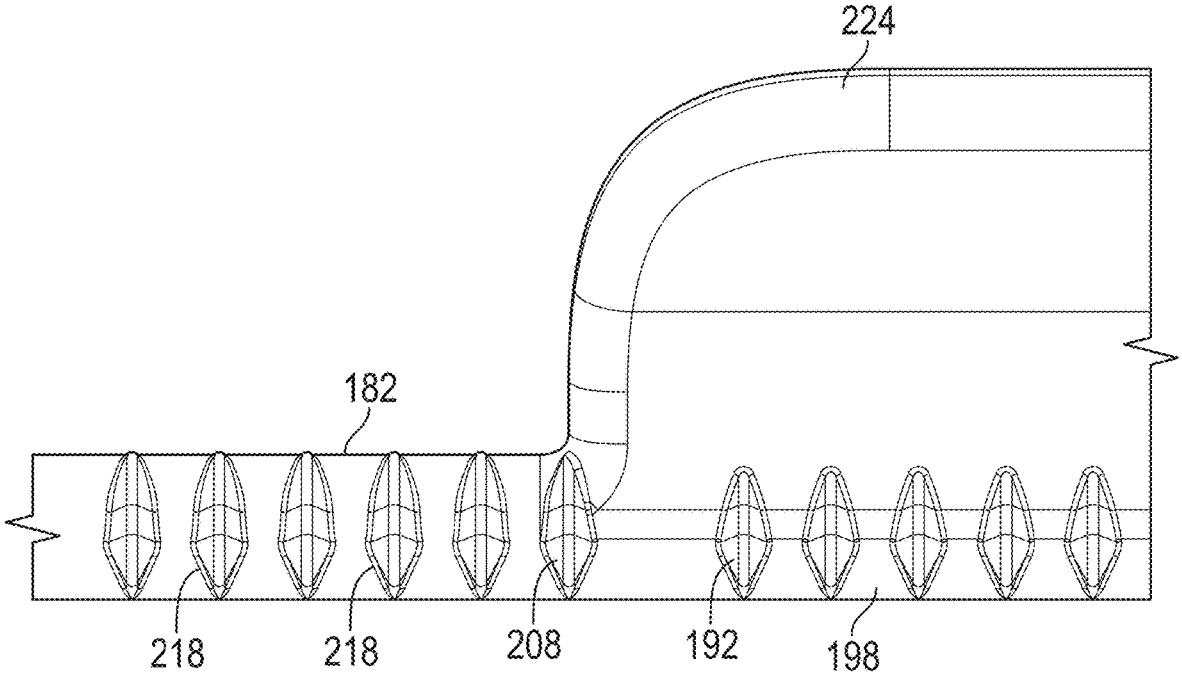
FIG. 7 is an enlarged partial perspective view of FIG. 5.

The locking mechanism 180 is configured with a self-aligning feature which ensures proper meshing of the first and second teeth 208, 210 even if initial alignment is imperfect because of the location of the organizing member 104. Particularly, in FIG. 6, the second teeth 210 are substantially wedge-shaped and include lead-ins 214 configured to compensate for minor misalignments during rotation of the first locking member 182 to the locked position by directing the first teeth 208 into engagement with the second teeth 210. The lead-ins 214 of the second teeth 210 are configured such that contact with the first teeth 208 shifts the organizing member 104 to align the first teeth 208 and second teeth 210 and allow the first teeth to interlock with the second teeth. To this end, as shown in FIG. 7, the first teeth 208 are also substantially wedge-shaped having leading edges 218 substantially triangular shaped in plan view. It should be appreciated that the substantially wedge-shaped first and second teeth 208, 210 provide secure locking when fully engaged and smooth disengagement of the first and second teeth 208, 210 when unlocking. Further, the substantially triangular shaped leading edges 218 are the initial contact with the lead-ins 214 and provide a gradual engagement of the first and second teeth 208, 210. The angles of the lead-ins 214 of the second teeth 210 are steep enough to effectively guide the first teeth 208 into position and provide sufficient lateral force for self-alignment of the first and second teeth 208, 210, but shallow enough to allow smooth engagement of the first and second teeth 208, 210 without excessive force and to prevent binding or jamming during rotation of the first locking member 182 to the locked position.

Figure 8:
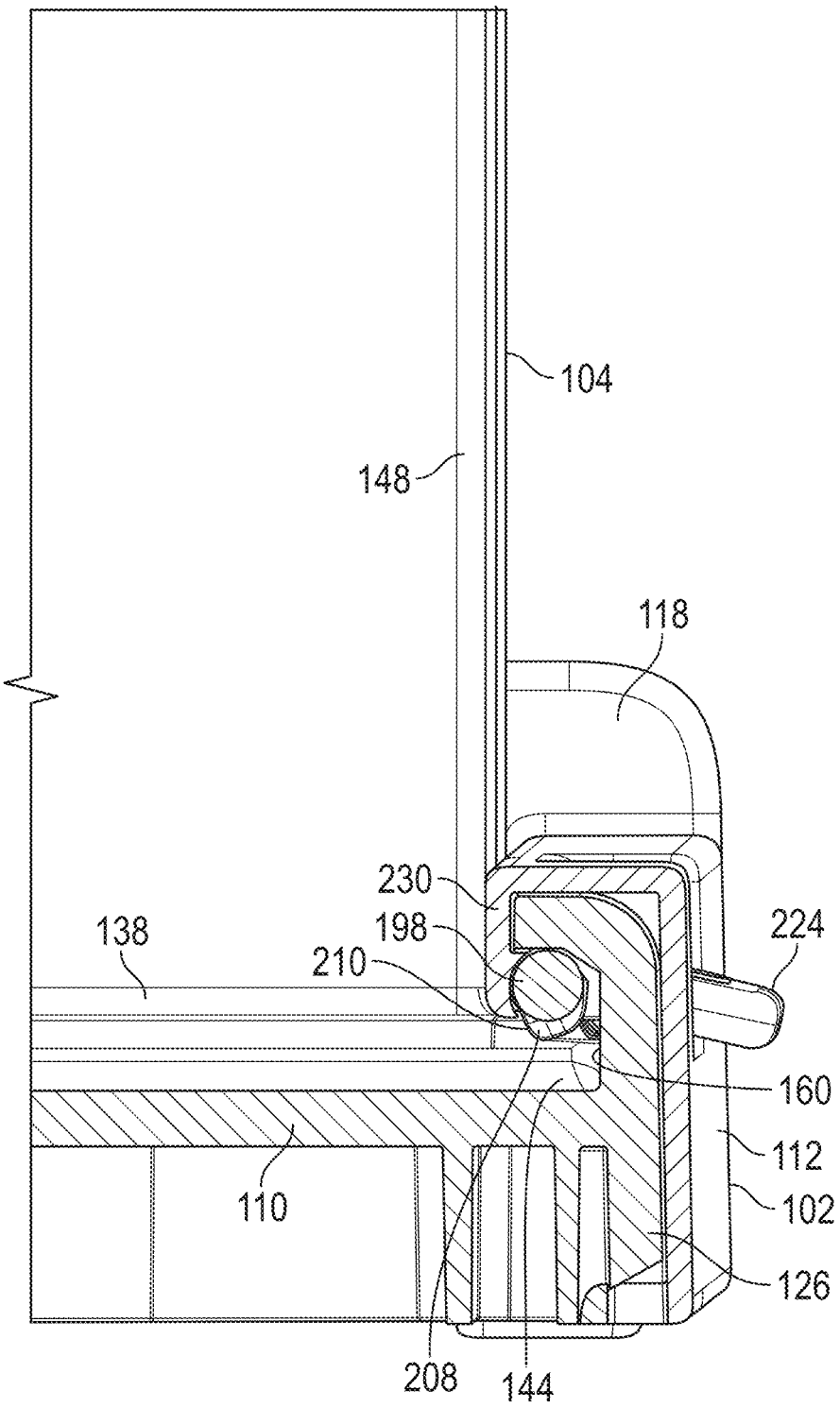
FIG. 8 is a partial cross-sectional view of FIG. 1.

When rotating the first locking member 182 to the locked position, the leading edges 218 of the first teeth 208 contact the lead-ins 214 as the first teeth 208 are rotated into engagement with the second teeth 210. As the leading edges 218 of the first teeth 208 are rotated into the second teeth 210, the angled surfaces of the lead-ins 214 via contact with the leading edges 218 will shift the organizing member 104, thereby ensuring smooth engagement and self-correction with less effort in achieving proper lock engagement. The first locking member 182 further includes a lock tab 224 connected to the bar 198 for manually rotating the first locking member 182 between the unlocked position and locked position. The first teeth 208 are additionally provided on an underside of the lock tab 224 allowing for locking of the organizing member 104 when aligned with the lock tab 224. FIG. 8 depicts the arrangement of the bar 198 on the support body 102. The bar 198 is provided above the first end portion 144 of the support wall 138 located in the track 160. The first sidewall 112 includes an upper portion 230 shaped to substantially conceal the bar 198 except for the track.

Accordingly, the locking mechanism 180 for the organizer 100 comprises the first locking member 182 and the second locking member 184. The first locking member 182 is rotatably secured by the support body 102. The first locking member 182 includes the first teeth 208. The second locking member 184 is provided on the organizing member 104. The second locking member 184 includes the second teeth 210 configured to meshingly interlock with the first teeth 208. The first locking member 182 is rotatable between the unlocked position where the first teeth and the second teeth are separated from one another and the organizing member 104 is slidable on the support body 102 and the locked position where the first teeth 208 are rotated into engagement with the second teeth 210 and a position of the organizing member 104 is locked relative to the support body 102. The second teeth 210 include the lead-ins 214 that direct the first teeth 208 into engagement with the second teeth 210.

It will be appreciated that various of the above-disclosed embodiments and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. An organizer comprising:

a support body;

an organizing member mounted to the support body and slidable relative to the support body; and a locking mechanism operable to lock a position of the organizing member relative to the support body, the locking mechanism including a first locking member secured by the support body and rotatable about an axis defined by the first locking member, the first locking member including a first engaging feature, and a second locking member provided on the organizing member and including a second engaging feature, wherein the first locking member is rotatable about the axis between an unlocked position where the first and second engaging features are separated from one another and a locked position where the first and second engaging features are directly engaged to one another, wherein the support body includes a track, and the organizing member is slidable within the track when the first locking member is in the unlocked position.

2. The organizer of claim 1, wherein the organizing member includes a support wall having an end portion received in the track.

3. The organizer of claim 1, wherein the first locking member includes an elongated bar having first and second end portions rotatably connected to the support body, and the axis is defined by the elongated bar.

4. The organizer of claim 3, wherein the first engaging feature includes spaced apart first teeth provided on the bar and the second engaging feature includes spaced apart second teeth adapted to meshingly interlock with the first teeth.

5. The organizer of claim 4, wherein the organizing member includes a support wall having an end portion, and the second teeth are integrally formed in the end portion.

6. The organizer of claim 4, wherein the second teeth include lead-ins configured to direct the first teeth into engagement with the second teeth.

7. The organizer of claim 6, wherein the lead-ins of the second teeth are configured such that contact with the first teeth shifts the organizing member to align the first teeth and second teeth and allow the first teeth to interlock with the second teeth.

8. The organizer of claim 6, wherein leading edges of the first teeth are substantially triangular shaped in plan view.

9. The organizer of claim 4, wherein the first locking member includes a lock tab connected to the bar for rotating the first locking member between the unlocked position and locked position.

10. The organizer of claim 9, wherein the first teeth are further provided on an underside of the lock tab.

11. The organizer of claim 1, wherein the organizer is a cookware organizer and the organizing member is a divider.

12. An organizer comprising:

a support body;

an organizing member mounted to the support body and slidable relative to the support body; and a locking mechanism operable to lock a position of the organizing member relative to the support body, the locking mechanism including a first locking member secured by the support body and rotatable about an axis defined by the first locking member, the first locking member including a first engaging feature, and a second locking member provided on the organizing member and including a second engaging feature, wherein the first locking member is rotatable about the axis between an unlocked position where the first and second engaging features are separated from one another and a locked position where the first and second engaging features are directly engaged to one another, wherein the first locking member includes an elongated bar having first and second end portions rotatably connected to the support body, and the axis is defined by the elongated bar, wherein the first engaging feature includes spaced apart first teeth provided on the bar and the second engaging feature includes spaced apart second teeth adapted to meshingly interlock with the first teeth.

13. The organizer of claim 12, wherein the first locking member includes a lock tab connected to the bar for rotating the first locking member between the unlocked position and locked position.

14. The organizer of claim 12, wherein the support body includes a track, and the organizing member is slidable within the track when the first locking member is in the unlocked position.

15. The organizer of claim 12, wherein the organizer is a cookware organizer and the organizing member is a divider.

* * * * *